United States Patent [19]

Magner

[11] 4,194,470

[45] Mar. 25, 1980

[54] TWO-CYCLE INTERNAL COMBUSTION ENGINE HAVING BOOST PORT

[76] Inventor: Richard W. Magner, 613 S. Ivy Way, Denver, Colo. 80224

[21] Appl. No.: 886,028

[22] Filed: Mar. 13, 1978

[51] Int. Cl.[2] ..... F02B 33/04

[52] U.S. Cl. ..... 123/73 A; 123/73 R

[58] Field of Search ..... 123/73 R, 73 A

[56] References Cited

U.S. PATENT DOCUMENTS

| | | | |
|---|---|---|---|
| 3,687,118 | 8/1972 | Nomuro | 123/73 A |
| 3,749,067 | 7/1973 | Kobayashi et al. | 123/73 A |
| 3,752,129 | 8/1973 | Kobayashi et al. | 123/73 A |
| 3,905,341 | 9/1975 | Boyesen | 123/73 A |

*Primary Examiner*—Wendell E. Burns

[57] ABSTRACT

A two-cycle internal combustion engine having a crankcase with a crankshaft rotatably mounted therein, a cylinder extending from the crankcase and having a piston slidably positioned therein with a connecting rod extending between the piston and the crankshaft, a combustion chamber defined at the end of the cylinder remote from the crankcase, an inlet channel communicating with the crankcase at one end and with an air-fuel mixture providing means at the other end, timing means to control opening and closing of the inlet channel to the crankcase, such timing means preferably being the piston skirt, a boost port extending from the inlet channel at a position between the air-fuel mixture providing means and the crankcase timing means at one end and opening to the cylinder volume at the other end, and a reed valve disposed in the boost port and oriented to control flow such that the air-fuel mixture may flow through the boost port into the cylinder but preclude reverse flow from the cylinder to the input channel.

6 Claims, 2 Drawing Figures

TWO-CYCLE INTERNAL COMBUSTION ENGINE HAVING BOOST PORT

BACKGROUND OF THE INVENTION

1. Field of the Invention

This invention relates generally to two-cycle internal combustion engines, and more particularly to two-cycle internal combustion engines in which the air-fuel mixture may be provided both to the crankcase for displacement to the combustion chamber by the downward moving piston through a transfer port, which further includes a boost port having associated therewith a reed valve to permit air-fuel mixture to flow directly from the inlet channel to the cylinder above the piston crown.

2. Description of the Prior Art

Two-cycle internal combustion engines are well known and have been highly developed. In one of the more basic embodiments, a two-cycle engine involves an inlet channel communicating with the crankcase of the relatively standard engine having a piston movably mounted in a cylinder and reciprocated by a rotating crankshaft. A vacuum is produced in the crankcase (as the piston moves in an upstroke direction) thereby drawing an intake mixture into the crankcase. As the piston moves in a downstroke direction, the pressure in the crankcase increases and the air-fuel mixture is displaced into the cylinder above the piston crown through a transfer port extending between the crankcase and the cylinder above the downward displaced piston. In order to preclude reverse flow of the air-fuel mixture out of the inlet channel, timing means, which may be the piston skirt closing a port, a reed valve, or rotary valve are provided. Otherwise, as is well known, the two-cycle engine provides a power stroke upon each downstroke with the exhaust gases first being expelled under the relatively high pressure of the combustion products, and a fresh air-fuel charge being immediately drawn therein by, for instance, displacement from the crankcase through the above-mentioned transfer port.

It is also well known that it is difficult to provide for optimum efficiency and power of a two-cycle engine under varying operating conditions. For instance, the specific timing of a piston port controlled crankcase timing means is necessarily fixed. Accordingly, if a piston seals off the intake channel early, the intake charge into the crankcase is severely limited at high operating rates. On the other hand, given the fixed timing of such an arrangement, if the piston seals the intake channel late, air-fuel mixture will be expelled back into the intake channel at low engine operating speeds. This phenomenon is a result of the differing characteristics of the intake air-fuel charge as the operating speed of the engine increases. At low operating speeds, such as upon starting, flow of the intake air-fuel mixture closely conforms to the timing means openings and pressure differentials. On the other hand, during operation at high engine speeds, substantial inertia is displayed by the air-fuel mixture. Thus the mixture does not immediately flow to obviate a pressure differential between the intake channel and the crankcase, and, similarly, maintains flow substantially beyond the existance of such a pressure differential as a result of the inertia of the flowing stream of air-fuel mixture.

To provide for the varying requirements of crankcase inlet timing under varying operating conditions, a reed valve has been employed in many instances. This arrangement is essentially a one way check valve which permits air-fuel intake mixture to flow upon demand in one direction and be precluded from reversing the direction of flow. When a vacuum condition exists in the crankcase, the reed valve will open and permit flow into the crankcase, but will close promptly upon the reversal of the pressure differentials which promote flow from the crankcase through the intake channel. Thus it will be recognized that the reed valve provides for a somewhat variable duration of the timing means controlling flow into the engine crankcase. Unfortunately, the reed valve is restrictive of air-fuel mixture flow under high operating speeds. When this is compounded by the inherent flow restriction of transfer ports, etc., the end result is that the reed valve provides for enhanced torque and power at low and mid-range operating speeds, but tends to compromise high speed engine efficiency.

One improvement upon the simple two-cycle engine described above, is that in which a reed valve is employed to control fuel flow into the crankcase, but a second intake channel is provided which communicates directly with the crankcase with piston skirt timing. Thus, the second channel is controlled and timed in a fixed manner by the piston skirt, while the primary channel is controlled by a reed valve. Accordingly, unobstructed flow past the piston skirt is provided as well as extended flow through the reed valve at mid operating speeds. Again, high speed operating is compromised by the inflexible timing of the piston skirt control and the inherent restrictions of the reed valve and transfer ports. However, enhanced mid-range operation is realized.

An even more useful arrangement is disclosed in U.S. Pat. No. 3,687,118. In this arrangement, a reed valve is provided between the air-fuel mixture providing means, i.e., a carburetor, and the crankcase. However, downstream of the reed valve, an auxiliary scavenge port is provided to permit flow directly into the cylinder above the piston crown and a piston controlled intake port is provided into the crankcase. In effect, this arrangement defines the entire volume downstream of the reed valve as an extension of the crankcase in the event reverse flow is induced prior to closing of the crankcase port. Thus some portion of the reverse flow may be directed to the auxiliary scavenge port and into the combustion chamber. Since the intake channel is piston skirt timed, the intake channel will be isolated from the crankcase prematurely at higher operating speeds. The air mixture continuing to flow at higher operating speeds as a result of inertia may be directly transferred through the auxiliary scavenging port to the cylinder above the piston crown. While this provides a useful improvement, again the intake channel is encumbered with reed valves restricting flow and the intake channel is also subject to the fixed timing of piston skirt control at the crankcase.

A variant but interesting embodiment of the concept of U.S. Pat. No. 3,687,118 is shown in FIG. 6. In this approach, only air is transferred from the crankcase to the combustion chamber and a fuel injection mechanism is provided in the auxiliary scavenging port. This requirement necessitates the inclusion of a reed valve to isolate the inlet channel from the auxiliary scavenging port. However, the complexity of a fuel injection system tends to defeat the efficiency of the two-cycle engine and still the air flow is subject to the restriction of reed valves located upstream of the auxiliary scavenging port. In fact the auxiliary scavenging port is subjected to the restriction of two reed valves in series.

U.S. Pat. No. 3,916,851 discloses an engine utilizing parallel independent intake means to provide stratified charge operation of a two-cycle engine.

In summary, while two-cycle engines are simple and can be collectively tuned to provide for easy starting, excellent fuel economy, extremely high power outputs etc., one of such desirable features is usually gained only through severly compromising another. For instance, high rpm, high power outputs, usually require piston skirt timing (or other fixed timing means such as rotary valves) of rather extreme duration. As a result, starting is often difficult and at mid-range the engine may "four cycle" in an inefficient manner. Only in the relatively narrow tuned high rpm area is the engine efficient.

SUMMARY OF THE INVENTION

The present invention provides a heretofore unavailable improvement over previously known two-cycle internal combustion engines. In essence, the engine involves a relatively conventional two-cycle engine with a conventional inlet channel, which may include the carburetor channel, inlet manifold and cylinder inlet porting, communicating with the crankcase through conventional timing means, preferably piston skirt timing but operably a reed valve or rotary valve positioned adjacent the crankcase. However, a power boost port is provided between the inlet channel at a position upstream of the timing means controlling the crankcase and downstream of the air-fuel mixture providing means. The power boost port thus communicates from the inlet channel to the cylinder at a position above the crown of the pistons when the piston is in a downstroke orientation. Opening of the boost port by the piston is of a relatively extended duration which may differ from that of the transfer ports, but a reed valve is provided in the power boost port. Accordingly, at low speed engine operation, the reed valve tends to diminish the timing of the boost port. Starting is thus relatively easy and low and mid-range torque and power tend to be enhanced. However, as the inertia of the air-fuel mixture in the intake channel increases with engine operating speed, the reed valve in the boost port is held open for greater duration thereby permitting increased amounts of air-fuel mixture to gain access to the cylinder above the piston crown and enhancing volumetric efficiency of the engine. Given the enhanced flow characteristics of the power boost port which communicates directly with the cylinder above the piston and particularly considering the straight flow path as opposed to the torturous route through the crankcase and up through transfer ports, the restriction of the reed valve in the power boost port is not as critical as the reed valve restrictions in the inlet channel under other arrangements.

Accordingly, an object of the present invention is to provide a new and improved two-cycle internal combustion engine in which the engine timing may be varied with a reed valve control boost port communicating with the cylinder above the piston crown during the intake charge.

Another object of the present invention is to provide a new and improved two-cycle internal combustion engine in which the crankcase and transfer port fuel charging may be timed in a selected fixed manner independent of the boost port.

These and other objects and features of the present invention will become more apparent from the following description.

DETAILED DESCRIPTION OF THE INVENTION

Figure 1:
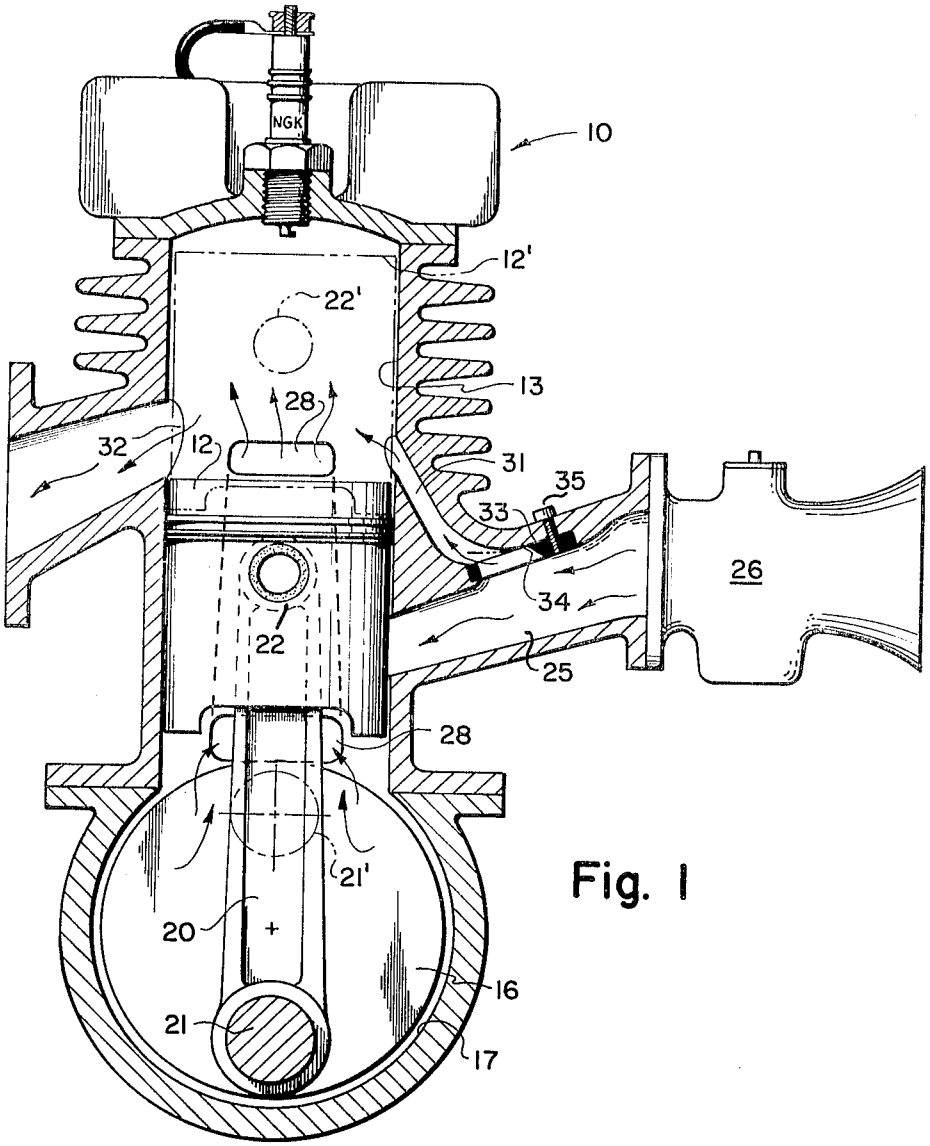
FIG. 1 is a transverse sectional view of a two-cycle internal combustion engine in accord with the instant invention.

Turning now to the drawings, wherein like components are designated by like reference numerals throughout the various figures, a two-cycle engine incorporating the improvement of the instant invention is illustrated in FIG. 1 and generally designated by reference numeral 10. Two-cycle engine 10 includes piston 12 slidably positioned in cylinder 13. As illustrated, piston 12 is at the bottom dead center position, and piston 12' is ghosted in the top dead center position.

Crankshaft 16 is rotatably mounted in crankcase 17 and connected to rod 20 at crankshaft throw 21. Rod 20 is also connected in an articulated manner to piston 12 at wristpin 22. The top dead center position of wristpin 22 is shown at 22'.

Figure 2:
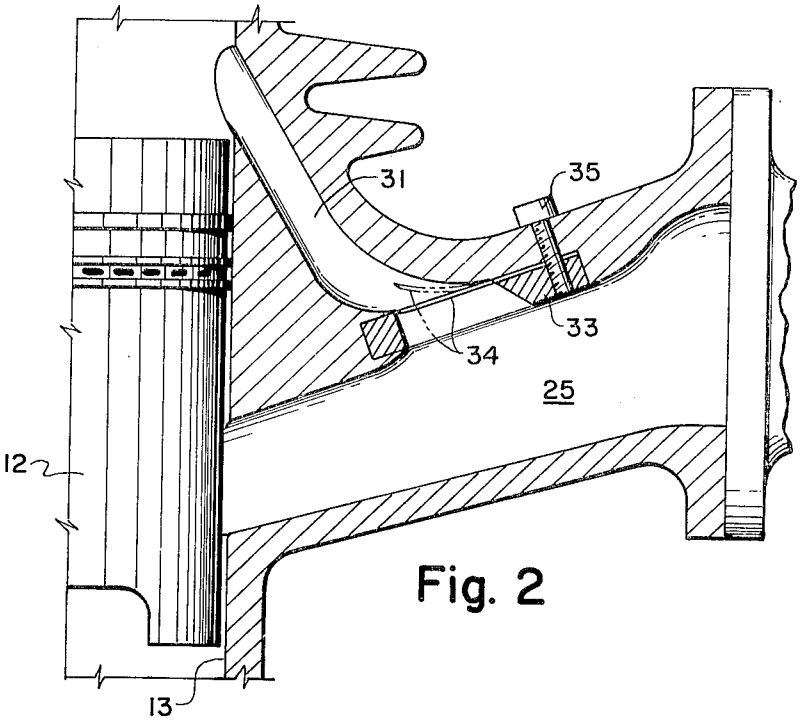
FIG. 2 is an enlarged view of the novel portion of the engine set forth in FIG. 1.

Inlet channel 25, which may include porting in cylinder 13, intake manifold, carburetor 26, etc., opens into crankcase 17 in such a manner as to be opened and closed by reciprocation of piston 12. Accordingly, as is illustrated in FIG. 2 particularly well, piston 12 in the bottom dead center position (as illustrated) serves to seal crankcase 17 from inlet channel 25, while the top dead center orientation of piston 12', as shown in ghosted manner in FIG. 1, permits flow into crankcase 17 from inlet channel 25. Transfer port 28 extending between crankcase 17 and the midportion of cylinder 13 serves to transfer mixture from crankcase 17 upon the downstroke of piston 12. In essence, the above-described features of two-cycle engine 10 are conventional features.

As shown particularly well in FIG. 2, a boost port 31 is defined between inlet channel 25 and cylinder 13 at a position above the crown of piston 12 in the bottom dead center position. Boost port 31 thus would serve to conduct air-fuel mixture from air-fuel mixture providing means, such as carburetor 26, to the cylinder 13 when the pressures and inertia of the fuel charge in inlet channel 25 are greater than the back pressure of the charge in cylinder 13. Since exhaust port 32 is open at this time, such back pressures are often lower within cylinder 13, particularly under relatively high operating rates. On the other hand, there will be a tendency for reverse flow from cylinder 13 to inlet channel 25 under certain conditions as piston 12 moves in an upstroke manner. Accordingly, reed block 33 carrying reeds 34 is positioned in the boost port 31 to preclude such reverse flow. Cap screws 35 may be employed to secure reed block 33, but in many instances reed block 32 would be formed integrally with the inlet to boost port 31.

Though boost port 31 is illustrated in what is believed to be an operable and desirable configuration, variations in the specific configuration are contemplated. For instance, inlet channel 25 can incorporate a relatively sharp downward turn to crankcase 17 with boost port 31 positioned at the outer radius of such turn. This will enhance flow through boost port 31 as the fuel charge tends to travel in a straight line. Also, in some instances, it may be desirable to provide an additional transfer port from crankcase 17 to cylinder 13, either through piston 12, or other configurations, with outlet of the additional transfer port adjacent the outlet of boost port 31. This will promote a venturi action inducing additional flow in boost port 31. Reed 33 may be positioned anywhere along the length of boost port 31, but is conveniently positioned at the inlet thereto.

In summary, the instant invention as described above provides for an open, basically unobstructed inlet channel with air-fuel producing means at one end and timing means at the other end to control flow into the crankcase. A boost port is defined from the inlet channel at a position between the air-fuel mixture generating means, such as carburetor 26, and the timing means and opens into the cylinder above the piston crown. Under high operating rates, a fuel charge may thus be provided directly through the boost port into the cylinder. Valve means such as a reed valve is provided in the boost port to preclude reverse flow from the cylinder. It has been found that this arrangement enhances the power output of a two-cycle engine, particularly under high rpm operating conditions.

Although only limited embodiments of the present invention have been illustrated and described, it is anticipated that various changes and modifications will be apparent to those skilled in the art, and that changes may be made without departing from the scope of the invention as defined by the following claims.

What is claimed is:

1. In a two-cycle internal combustion engine having a crankcase, a cylinder communicating with the crankcase, a combustion chamber defined at the end of the cylinder opposite the crankcase, a piston slidably mounted in the cylinder, a crankshaft rotatably mounted in the crankcase, a connecting rod extending between the piston and the crankshaft, a transfer port defined between the crankcase and cylinder, an inlet channel communicating with the crankcase at one end, with an air-fuel mixture providing means at the other end, and backflow timing means controlling communication of air-fuel mixture providing means and the crankcase, the improvement comprising:

a boost port defined between the inlet channel at a position between the air-fuel mixture providing means and the backflow timing means with the inlet channel being unobstructed between the air mixture providing means and the entrance to the boost port, the boost port extending to and communicating through the cylinder at a position above the piston crown when the piston is in a downstroke orientation; and a valve means positioned at the boost port and oriented to permit flow only from the inlet channel and preclude flow in the opposite direction;

whereby an air-fuel mixture may flow from the air-fuel mixture providing means to the inlet channel into the crankcase, and also through the boost port into the cylinder, and upon termination by the backflow timing means of flow into the crankcase, flow may be selectively provided into the cylinder at high operating speeds through the boost port, while reverse flow through the boost port is precluded at low operating speeds.

2. A two-cycle internal combustion engine as set forth in claim 1 in which the valve is a reed valve.

3. A two-cycle internal combustion engine as set forth in claim 1 in which the reed valve is positioned at the opening of the boost port from the inlet channel.

4. A two-cycle internal combustion engine as set forth in claim 1 in which the boost port opens through the cylinder at a position axially spaced along the cylinder from the opening of the transfer port into the cylinder.

5. A method of operating a two-cycle internal combustion engine having a crankcase, a cylinder communicating with the crankcase, a combustion chamber defined at the end of the cylinder opposite the crankcase, a piston slidably mounted in the cylinder, a crankshaft rotatably mounted within the crankcase, a connecting rod extending between the piston and the crankshaft, a transfer port defined between the crankcase and cylinder adjacent the combustion chamber, an inlet channel communicating with the crankcase at one end and having an air-fuel mixture producing means at the other end, backflow timing means controlling the communication of the air-fuel mixture producing means with the crankcase, and a boost port having valve means positioned therein extending between the cylinder and the inlet channel at a position between the air-fuel mixture providing means and the entire backflow timing means with the inlet channel being unobstructed between the air-fuel mixture providing means and the entrance to the boost port, comprising:

moving the piston in an upstroke direction to generate a low pressure volume in the crankcase;

inducing a flow of air-fuel mixture through the inlet channel past the open backflow timing means and into the low pressure volume in the crankcase as the piston moves in an upstroke direction;

opening the valve means and inducing a flow from unobstructed inlet channel through the boost port into the cylinder at a position above the crown of the piston while the piston crown is in a position below the outlet of the boost port into the cylinder;

closing the backflow timing means to seal the crankcase from the inlet channel as the piston moves in a downstroke direction;

displacing air-fuel mixture from the crankcase through the transfer port to a position above the piston crown; and maintaining the valve means in an open condition after the backflow timing means is closed and maintaining unobstructed flow through the boost port from the unobstructed portion of the inlet channel between the air-fuel mixture providing means and the boost port to the cylinder above the piston crown independent of the crankcase and after communication between the inlet channel and the crankcase is terminated;

whereby at high operating rates, the engine benefits from additional air-fuel mixture being conducted from the unobstructed inlet channel to the cylinder above the piston crown after the backflow timing means seals the inlet channel from the crankcase thereby increasing volumetric efficiency.

6. A method of operating a two-cycle internal combustion engine as set forth in claim 5 in which the backflow timing means comprise the piston skirt opening and closing the outlet of the inlet channel into the crankcase as the piston reciprocates and the valve means comprise a reed valve positioned in the boost port and oriented to permit flow from the unobstructed portion of the inlet channel to the cylinder but to preclude flow in the opposite direction.

* * * * *